US005554088A

United States Patent [19]

Zlojutro

[11] Patent Number: 5,554,088

[45] Date of Patent: Sep. 10, 1996

[54] SPORT TRAINING BAG AND SUPPORT

[76] Inventor: Milan Zlojutro, 1940 E. Diamond Ave., Mesa, Ariz. 85204

[21] Appl. No.: 527,021

[22] Filed: Sep. 12, 1995

[51] Int. Cl.[6] ..... A63B 67/00

[52] U.S. Cl. ..... 482/83; 482/87; 482/89

[58] Field of Search ..... 482/83–90; 273/55 A, 273/55 R; 269/87.2, 74, 3, 269, 88

[56] References Cited

U.S. PATENT DOCUMENTS

| | | | |
|---|---|---|---|
| 1,267,678 | 5/1918 | McArdle | 482/89 |
| 2,088,861 | 8/1937 | Klum | 273/55 A |
| 2,249,309 | 5/1938 | Benko | 482/89 |
| 4,557,478 | 12/1985 | Levine | 482/89 |
| 4,736,947 | 4/1988 | Jenkins | 273/55 R |

*Primary Examiner*—Jerome Donnolly
*Attorney, Agent, or Firm*—Gregory J. Nelson

[57] ABSTRACT

A support for a martial arts and punching bag which has a base supported on legs. A mast is vertically adjustable with respect to a tube extending from the base. A horizontal arm extends from the mast and terminates at a coupling. A generally C-shaped bag suspension frame is adjustable with respect to the coupling so the height and angular position of the bag may be varied.

In other embodiments, the suspension frame is attached to a carrier which is vertically adjustable by a ratchet mechanism. Shock absorbing and bag tensioning means may also be provided. The punching bag may be cylindrical or other shapes depending on the requirements of the user.

9 Claims, 6 Drawing Sheets

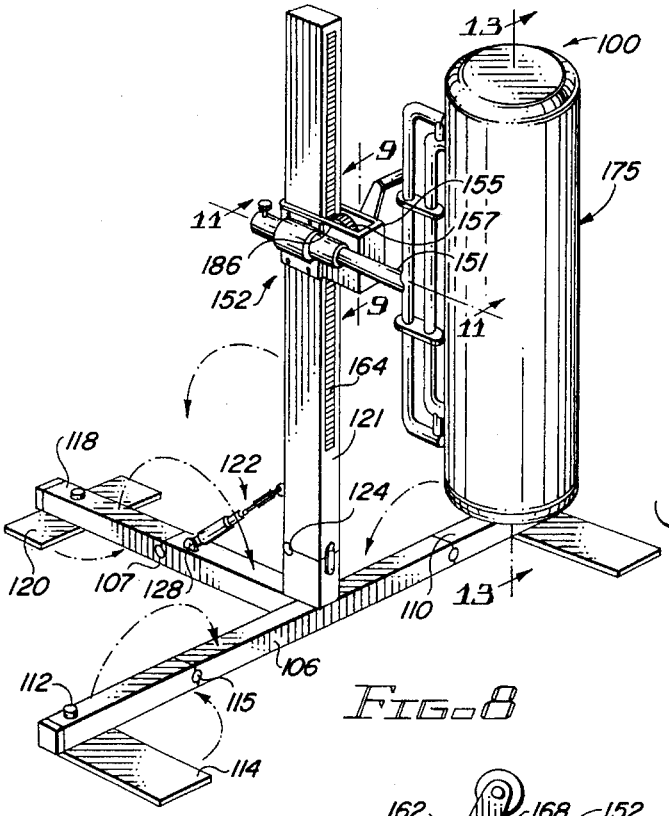
FIG. 8
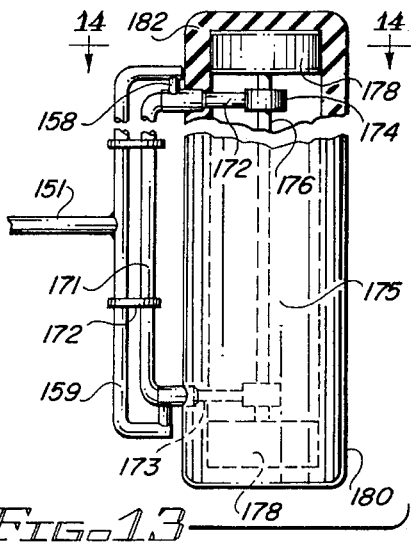
FIG. 13
FIG. 14
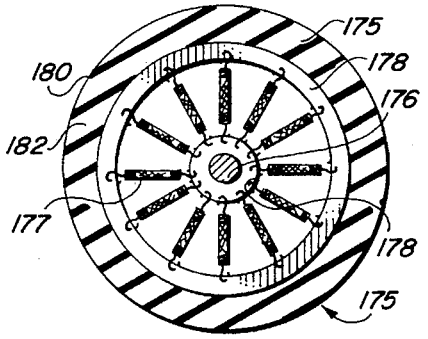
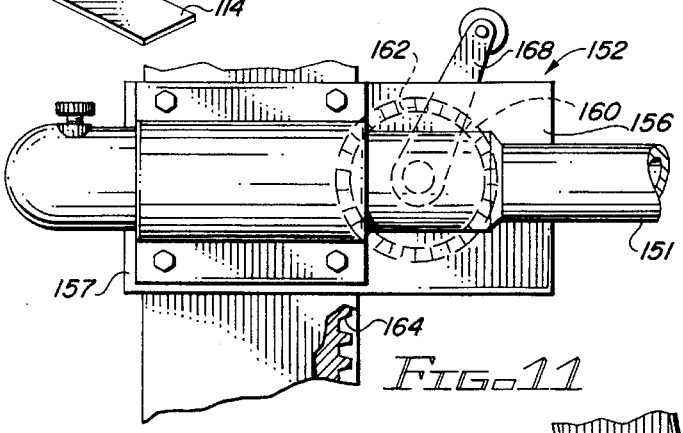
FIG. 11
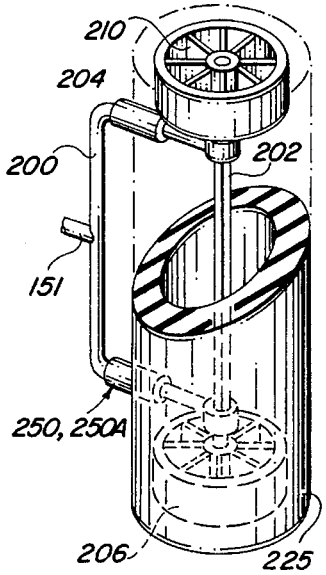
FIG. 15
FIG. 12
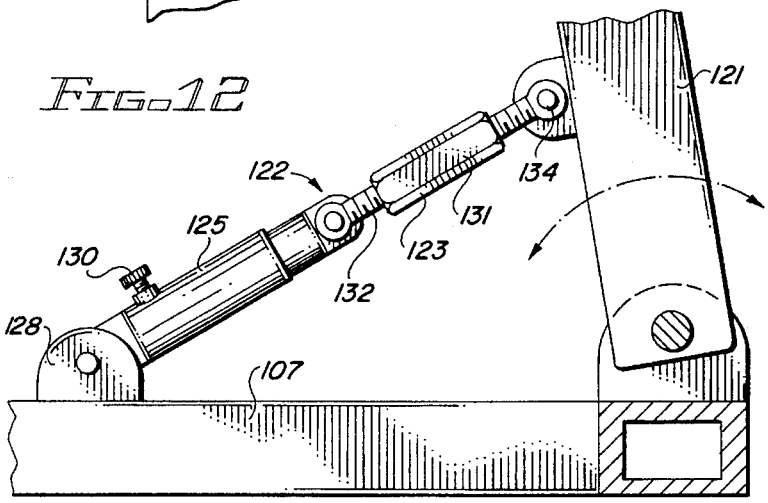

SPORT TRAINING BAG AND SUPPORT

BACKGROUND OF THE INVENTION

FIELD OF THE INVENTION

The present invention relates to a sport training device and more particularly relates to a new and improved training bag for training bag for boxers and participants in sports activities such as martial arts.

An important type of training equipment used by participants in martial arts and boxing is the bag. The lighter speed bag is a small leather bag that is suspended by a metal swivel from a platform. The primary purpose of using a speed bag is to develop hand quickness and increase punching speed. The light speed bag is effective for this limited purpose.

Another type of bag used by boxers and also by martial arts participants is the heavy bag which is a large canvas or leather covered bag which is suspended by a chain and which represents the body of an opponent. The bag is filled with sand, sawdust or similar material and is used by the boxer or martial arts participant to develop strength and leverage of punches and kicks.

A major deficiency in conventional bags is that they are useful in practicing or developing power only for certain types of punches. Prior art bags are helpful in developing power jabs and straight punches delivered by the left or right hand. However, conventional bags are not particularly helpful in training the fighter or martial arts participant in other types of blows such as upper cuts and various kicks. Also, conventional bags being of only several limited shapes, do not permit the user to practice a variety of skills and techniques. The heavy bag as mentioned above, is generally suspended from a swivel chain or rope and has limited adjustment capability. Therefore, if a person practicing martial arts wishes to position the heavy bag at a certain height, angle or inclination, such is not possible.

It is also desirable to be able to position a practice punching bag at various angles in order to minimize possible injury to the ankle, knee or hip joint of the person practicing the kicking and such orientation is not possible with the conventional body punching bag.

Accordingly, a primary object of the present invention is to provide a new and improved training bag for boxers and participants in the martial arts.

Another object of the present invention is to provide a new and improved training bag which can be utilized to sharpen the accuracy, force and timing of punches and kicks.

Another object of the present invention is to provide a new and improved training bag which provides universal adjustability of the bag position to allow the user to practice a wide variety of punching, boxing and kicking skills.

Another object of the present invention is to provide an improved martial arts and boxing training bag in which bags of various configurations can be used in order to enhance the training procedure.

In addition to the conventional speed and body punching bags discussed above, a number of patents can be found in the prior art which disclose training, boxing and martial arts training devices and the following are believed to be representative of the prior art in this area.

U.S. Pat. No. 5,183,450 shows a martial arts training apparatus which is in the form of a cylindrically-shaped bag including a generally cylindrical-shaped smaller bag which simulates the human leg. The second bag is suspended from the lower portion of the larger bag.

U.S. Pat. No. 5,362,289 shows a martial arts focus training apparatus comprising a backboard which is grasped by assistants. The device is intended for use in board-breaking exercises.

U.S. Pat. No. 5,026,048 shows a martial arts training bag having internal compression springs extending from the support pole. A circumferential plate extends around the springs and is covered by padding to absorb the shock of the blows.

U.S. Pat. Nos. 4,973,045; 4,491,316; and 5,277,679 all show devices for practicing martial arts, each of which have a mast which adjustably supports the target.

SUMMARY OF THE INVENTION

Briefly, the present invention provides a martial arts training and support bag which allows the user to adjust the position of the bag and also adjust the tension or resistance exhibited by the bag upon receipt of a blow. In the preferred embodiment of the invention, the training device has a support which has a base having two or more extending legs which are supported on adjustable casters. The casters can be pivoted to a use-position to allow the device to be easily transported. In the non-use position, the casters are out of the way and the legs rest on elastomeric pads. The base includes an upright support tube which receives a mast which is rotatable about a vertical axis. A horizontal arm extends from the mast and supports a coupling which is rotatable about a horizontal axis. In addition, a suspension frame member is adjustable with respect to the coupling. The suspension frame is generally C-shaped and has flexible suspension means such as a chain which support a bag of selected shape at opposite ends of the bag.

In another embodiment of the invention, the support has a carrier with a ratchet mechanism which has a horizontal arm that supports the bag suspension frame. The carrier is vertically adjustable along the post by the ratchet mechanism. Various other mechanisms such as lead screw arrangements may also be used to achieve adjustability. The suspension frame also permits the position and tension of the bag to be adjusted.

Shock absorbing means may be incorporated in the support structure to absorb blows imparted by the user. Bags of various shapes and configurations can be attached to the support and the bag may be cylindrical in shape or may be circular or other shapes. The bag may be hollow and have an internal suspension with external padding for reduced weight.

BRIEF DESCRIPTION OF THE DRAWINGS

The above and other objects and advantages of the present invention will become more apparent from the following description, claims and drawings in which:

FIG. 8 is a perspective view of an alternate embodiment of the sport training apparatus of the present invention;

FIG. 11 is a sectional view taken along line 11—11 of FIG. 8;

FIG. 12 is a partial detail view of a tilt adjusting and shock absorbing mechanism shown in FIG. 8;

FIG. 13 is a sectional view taken along line 13—13 of FIG. 8 showing the details of construction of the punching bag;

FIG. 14 is a sectional view taken along line 14—14 of FIG. 13;

FIG. 15 is a perspective view partly broken away showing another bag suspension arrangement which may be used with the embodiment of the invention shown in FIG. 8.

Turning now to the drawings, FIGS. 1 through 7 illustrate a preferred embodiment of the training apparatus of the present invention which is generally designated by the numeral 10 which apparatus includes a bag 12 which is supported and adjustably suspended from a suspension frame 14 which is selectively adjustable with respect to support 15. The support 15 includes a plurality of outwardly projecting legs 18, three are shown, spaced approximately 120° apart and are preferably constructed from suitable steel sections which, at their intersection, support vertically extending post 20. Post 20 defines a bore 22 which receives mast 24. Mast 24 has annular teeth 26 which permit vertical adjustment of the position of the mast relative to the post as explained below. The mast carries integral arm 28 which projects at right angles with respect to the vertical axis of the post. The arm 28 carries a coupling 30 which, as best seen in FIGS. 2 and 5, supports the suspension frame 14. FIG. An important feature of the invention is that the angular position and the height of the mast relative to the support may be adjusted to accommodate the requirements of the user. Once the desired rotational position of the mast is obtained, further rotation of the mast is prevented by locking arm 32 which is in threaded engagement in boss 37 on the post. The inner end of the locking arm 32 bears against tile mast to prevent rotation. The height of the mast may be adjusted by extending or retracting tile mast with respect to the post 20. Once the desired height is established, the mast is secured in the position by detent 34. Detent 34 consists of a spring arm 35, one end of which is secured to the exterior of the post at fastener 36. A detent pin 38 projects through an aperture 39 in the post and in the locked position as shown in FIG. 5 will engage a selected annular recess between teeth 26 along the mast. The detent can be unlocked by exerting an outward manual force on the spring arm 35.

The coupling 30 adjustably secures the mast to the suspension frame 14. The coupling includes a cylindrical collar 42 which receives tile distal end of arm 28. The arm 28 has an annular recess 44 disposed near its outer end. As seen in FIG. 5, inwardly of the recess are a plurality of radially extending apertures 46. The collar is provided with a detent mechanism 45 which includes spring arm 47 secured in place by a screw 48 which is aligned with the annular recess 44. The detent carries a pin 49 which is registrable with selected of the radial apertures 46 to establish the angular position of the collar and the suspension frame 14 with respect to the arm 28. The collar carries a sleeve 50 which receives the frame 14.

The suspension frame 14 consists of a tubular member of suitable material such as steel or may be a composite structure such as carbon graphite or similar material. The frame 14 has a general C-shaped configuration as best seen in FIG. 1 terminating at an upper end 52 and a lower end 54, respectively defining holes 65 and 66. The distance between ends 52 and 54 provides clearance sufficient to receive the punching bag 12. The frame member 14 is vertically slidable relative to sleeve 50 which sleeve is integrally formed with the horizontal collar member 42. Frame member 14 is provided with a plurality of generally longitudinally aligned holes 55 at the lower end of the bag. As seen in FIG. 7, the holes 55 may be selectively aligned with detent pin 56 of detent mechanism 58 on sleeve 50 to permit adjustment of the frame 14 relative to the sleeve.

Figure 1:
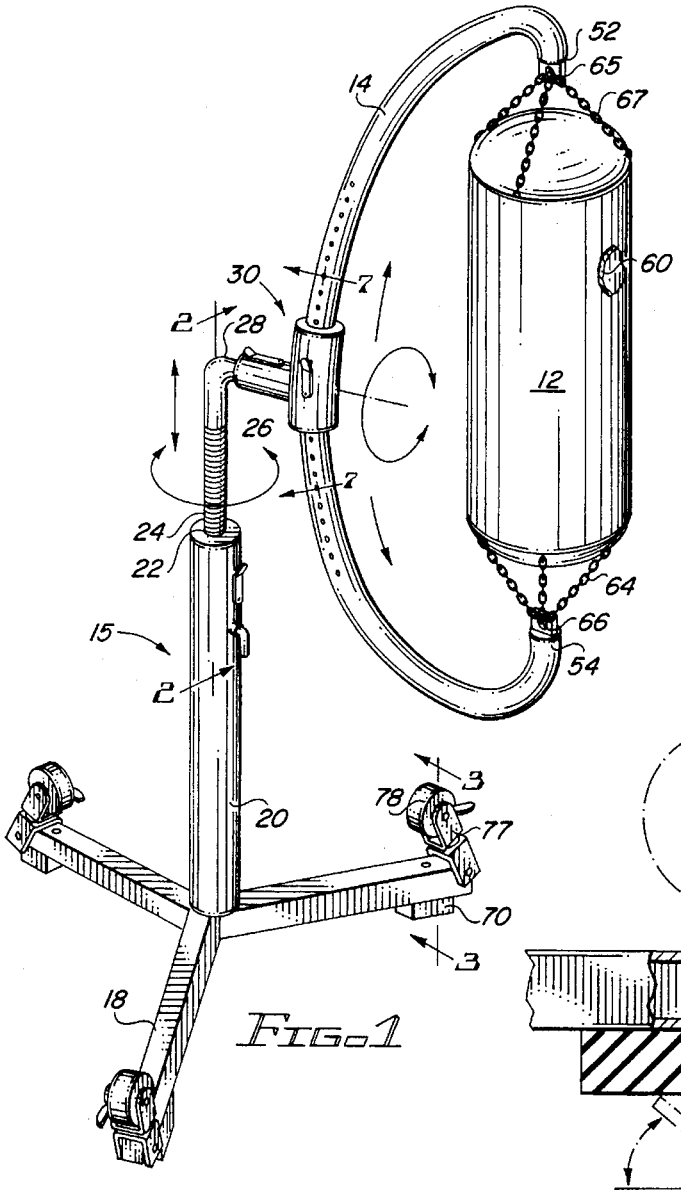
FIG. 1 is a perspective view of a preferred embodiment of the punching bag apparatus of the present invention.

The bag 12 is shown as a generally cylindrical bag having an exterior shell 60 of canvas or leather and is filled with a suitable material. Chains 64 extend from the bottom of the bag and are engaged in the aperture 66 at the lower end 54 of the frame. Similarly, the upper end of the bag is suspended from chains 67 engaged in aperture 65 in the upper end 52 of the frame.

It will be seen from the foregoing, the construction provides multiple adjustability of the bag position. The height of the bag 12 may be adjusted by adjusting the position of the mast relative to the post 20 at detent 35. The bag can be tilted by adjusting the suspension frame 14 relative to its supporting collar 30. The bag may also be rotated to any angular desired position between vertical and horizontal by rotating the collar 30 relative to the horizontal arm 28. In this way, the user can select the position of the bag desired to obtain the particular work out. The bag may be used as a conventional punching bag or may be positioned for specialized practice such as the practice of martial arts kicks.

Figure 3:
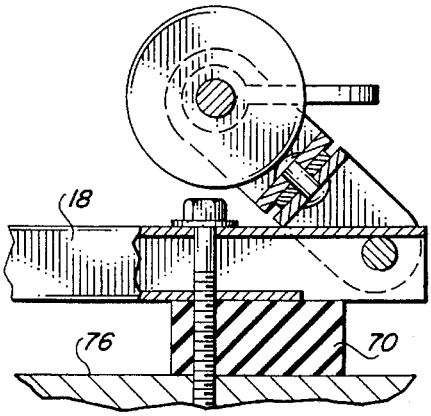
FIG. 3 is a sectional view taken along line 3—3 of FIG. 1.
Figure 4:
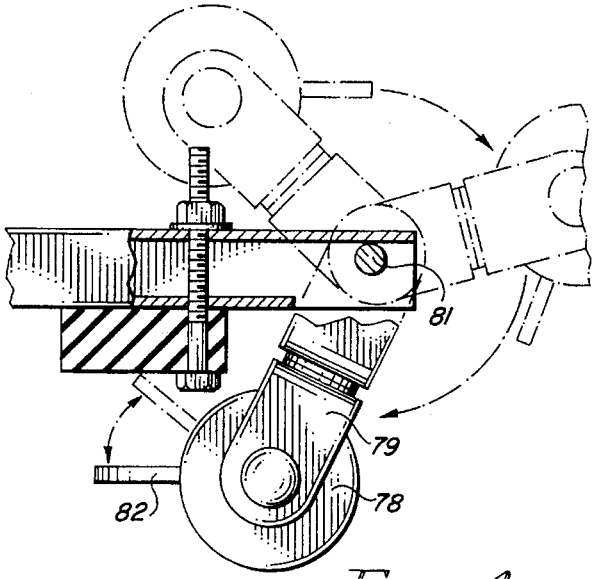
FIG. 4 is a view similar to FIG. 3 showing the casters in a mobile position.

The punching bag may be easily transported between locations of use and storage by means of casters as shown in FIGS. 1, 3 and 4. Each of the legs 18 carries an elastomeric pad 70 on its bottom side. In the use position as shown in FIGS. 1 and 3, the elastomeric pad 70 will engage the floor surface 76 to provide both shock absorbing features and resist movement or displacement of the apparatus while in use. When it is desired to move the apparatus, the caster assembly can be moved to the position shown in FIG. 4 for ease of transportation. The caster assembly includes conventional caster wheels 78 carried on axle assembly 79 pivotally attached to the ends of each of the legs 18 at pivot point 81. When the casters are in the down position as shown in FIG. 4, lever 82 is provided with each caster to lock the caster wheels 78 against rotational movement. The construction of such lockable caster assemblies are well known and can be commercially acquired from conventional supply sources.

An alternate embodiment of the punching bag assembly of the present invention is shown in FIG. 8 and is generally designated by the numeral 100. In this embodiment, the punching bag apparatus has a base which has a transversely extending member 106 and a rearwardly extending leg member 107 disposed at a right angle with respect to member 106. Feet 110 and 112 are pivotally secured at the outer ends of base member 106 at pivots 115. Each of the feet have a pad 114 secured to its underside. Similarly, foot 118 is pivotally secured to the distal end of leg 107 and carries a pad 120. It will be appreciated that the base can be folded to a more compact position by upwardly and inwardly folding the foot pads 110, 112 and 118 to a position each overlying their respective associated base members.

The adjustable mast assembly includes a vertical post 121 which is shown as being a generally rectangular steel section which is pivotally secured to the base at pivot point 124. An adjustable shock absorbing assembly 122 extends between the post 121 and the rearwardly extending base member 107. The shock absorbing assembly shown in detail in FIG. 12 includes a cylinder 125 having its head end pivotally secured to the base member 107 at trunion 128. The rod end of the cylinder is pivotally connected to member 123. Member 123 includes an adjustable nut 131 and is similar to a turn buckle. The opposite end of member 123 is pivotally attached to post 121 at 134 to allow the angular position of the mast assembly to be adjusted from a vertical position to a selected angular position such as shown in FIG. 12. The cylinder 125 may be a simple hydraulic cylinder with an internal piston which will serve as a shock absorber. The shock absorbency of the cylinder can be adjusted at screw 130 which serves to selectively restrict the flow path between the fluid chambers at the opposite side of the piston within the cylinder in known fashion.

Bag 175 is carried on a suspension frame which includes a horizontal arm 151. The vertical position of the suspension assembly can be adjusted at the lift mechanism. As seen in FIGS. 8, 9, 10 and 11, the lift mechanism includes a carrier 152 having opposite side plates 155, 156 and end plate 157 which form a housing in engagement with the sides of the mast 121 to guide the movement of the carrier. A gear wheel 160 is supported for rotation between the housing side walls having gear teeth 162 which engage the teeth of rack 164 extending along the face of the mast. The gear 160 is manually rotated by means of crank 168. Thus, the desired vertical position of the carrier 152 and accordingly the vertical position of the support 151 can be adjusted by rotation of crank arm 168 to raise or lower the suspension frame and bag.

Figure 9:
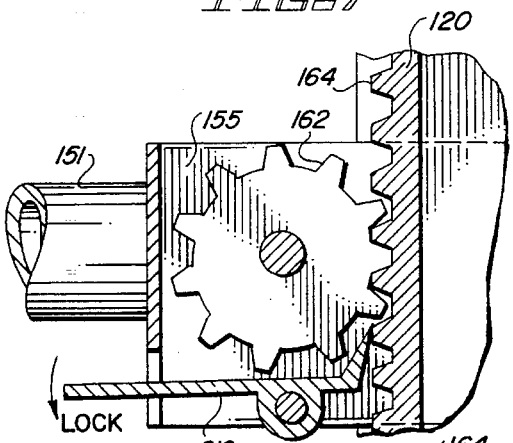
FIG. 9 is a sectional view taken along line 9—9 of FIG. 8.
Figure 10:
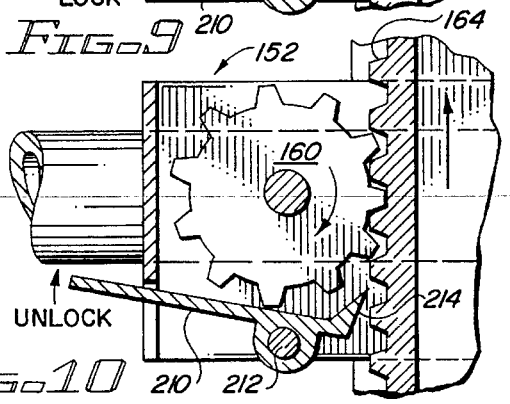
FIG. 10 is a view similar to FIG. 9 showing the ratchet mechanism in an unlocked position.

FIGS. 9 and 10 show a security locking device that may be provided as part of the carrier 152 to lock the carrier in a desired position. The carrier housing includes a locking lever 210 which is pivotally secured to the housing at shaft 212. The inner end of the lever 210 carries a wedge member 214 which, in the normal position, engages the interface between the gear wheel 160 and the vertical rack 164 on the support. The wedge prevents slippage or movement of the gear wheel relative to the rack. If the user wishes to adjust the elevation of the bag, the lever 210 is moved to the unlocked position by moving it upwardly as shown in FIG. 10 to disengage it from the interface between the rack and gear teeth.

The bag 175 and the suspension assembly are best seen in FIGS. 13 and 14. A first generally C-shaped suspension frame member 159 is secured to the end of the arm 151. The opposite ends of member 159 each carry inwardly extending bearing pins 158 which engage the opposite ends of inner support member 171. Support members 171 extend from the support member 159 about the inner support member 171 to stabilize the inner support member for rotation about the axis defined by pins 158.

The inner support member is secured to the bag 175 by upper and lower arms 172 and 173. These arms each terminate at an annular member 174 which receives the internal vertical support rod 176 within the bag 175. The support rod 176 terminates at either end at disks 178 which are secured to hubs 178 at the ends of rod 176 by resilient biasing members such as springs 177. The shell of the bag includes an exterior covering such as canvas or leather 180 over suitable padding 182 which is supported at opposite ends by the interior disks 178. This construction considerably lightens the bag eliminating the need for heavy filling of sand or other material. The suspension system allows the bag to be angularly adjusted about several axis. The entire assembly can be rotated by rotating the support arm 151 relative to the carrier 152. The elevation of the bag can be adjusted by adjusting the position of carrier 152 relative to the mast. Similarly, the bag can be placed in an offset position by rotating the bag to cause the inner suspension frame 171 to pivot relative to the outer suspension frame member 159. The resilient member 179 serves to absorb the impact of blows returning the bag to its normal position.

Figure 16:
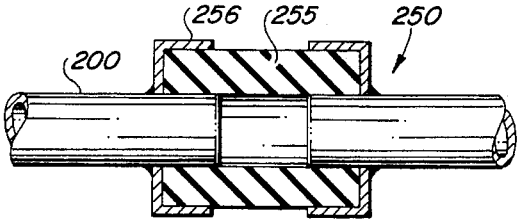
FIGS. 16 and 17 show shock absorbing members that may be interposed in the bag support frame.
Figure 17:
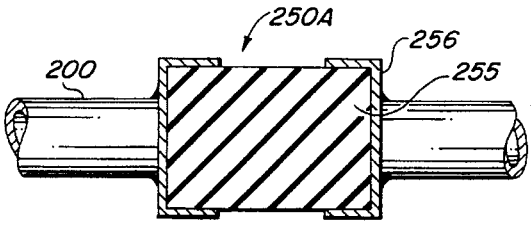
Figure 5:
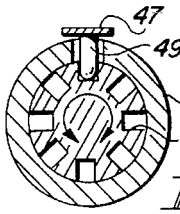
FIG. 5 is a sectional view taken along line 5—5 of FIG. 2.
Figure 7:
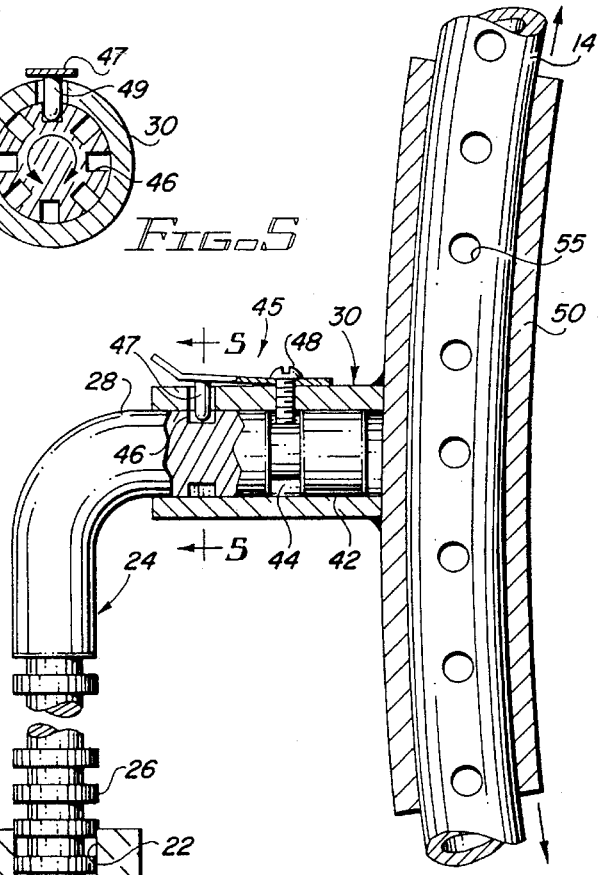
FIG. 7 is a sectional view taken along line 7—7 of FIG. 1.
Figure 7:
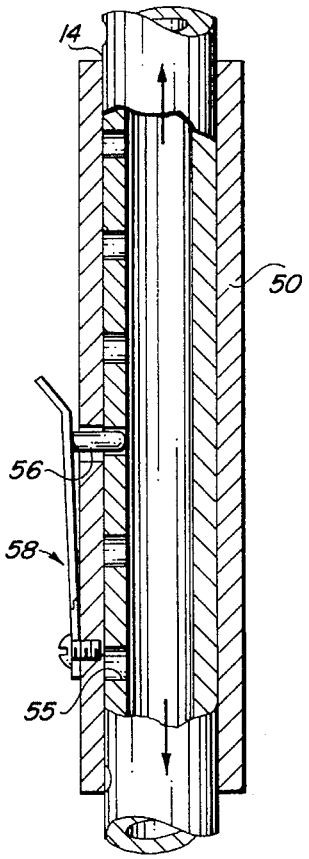
Figure 2:
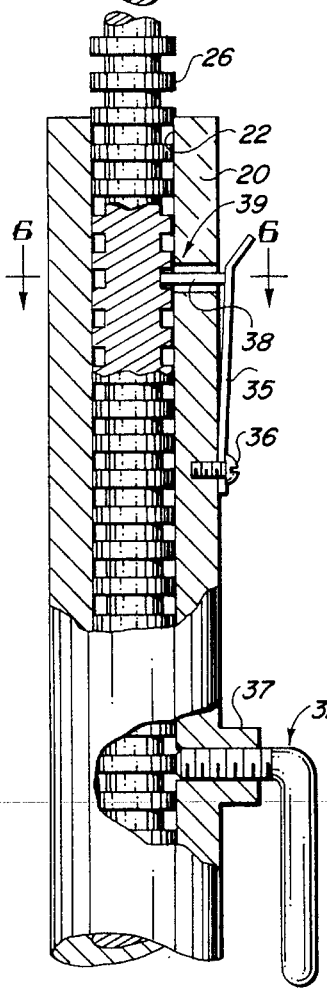
FIG. 2 is a sectional view taken along line 2—2 of FIG. 1.
Figure 6:
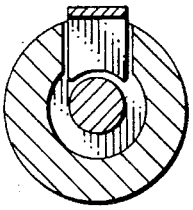
FIG. 6 is a sectional view taken along line 6—6 of FIG. 2.

In FIG. 15 a simplified bag support system is shown having a C-shaped frame member 200 attached to arm 151. Member 200 supports vertical rod 202 which has rings 204 and 206 at its opposite ends. The rings are secured to the rod by radial arms 210. Padded bag 225 extends over and is supported by the rings. Shock absorbers such as shock absorber 250 or 250A, shown in either FIG. 16 or 17, may be interposed in the horizontal section of support frame member 200 or in arm 151. A resilient insert 255 is secured in place by caps 256. In FIG. 16, the insert is annular and in FIG. 19 the insert 255A is cylindrical.

Figure 19:
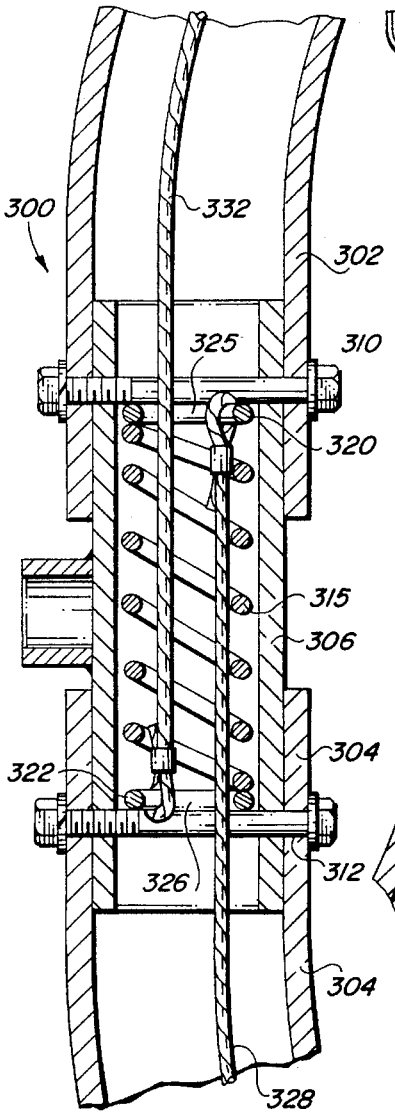
FIG. 19 is a sectional view taken along line 19—19 of FIG. 18 showing the alternate arrangement for adjustably securing the bag to a suspension frame.
Figure 21:
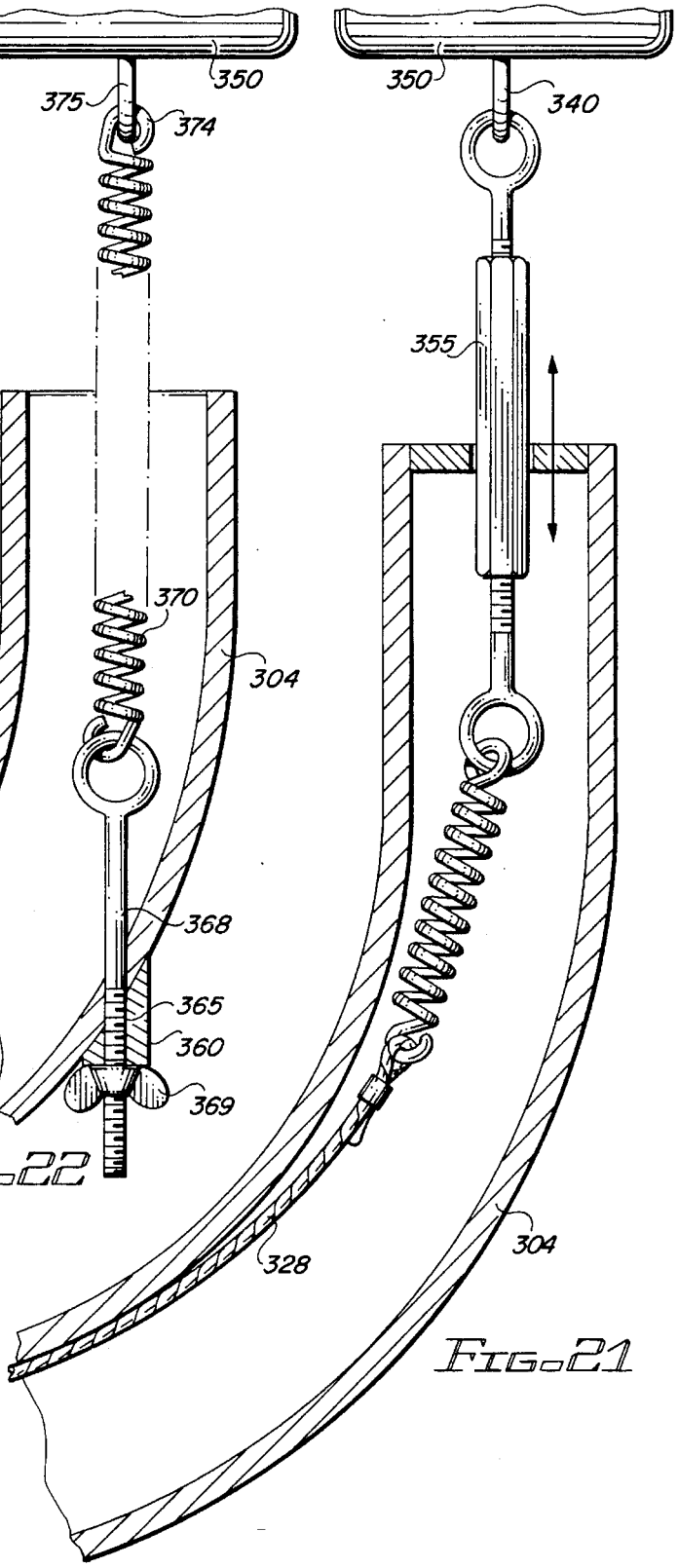
FIG. 21 is a sectional view of an end of the bag suspension frame.
Figure 20:
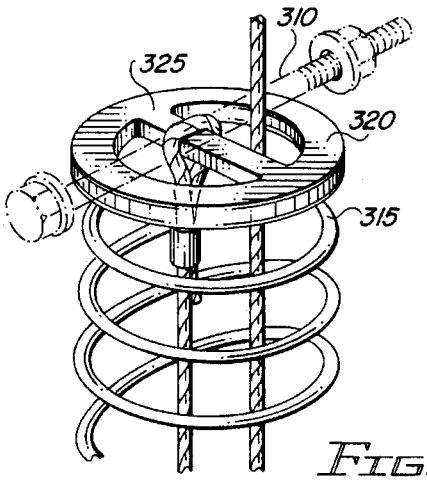
FIG. 20 is a perspective view of the spring resistance mechanism shown in FIG. 19.
Figure 18:
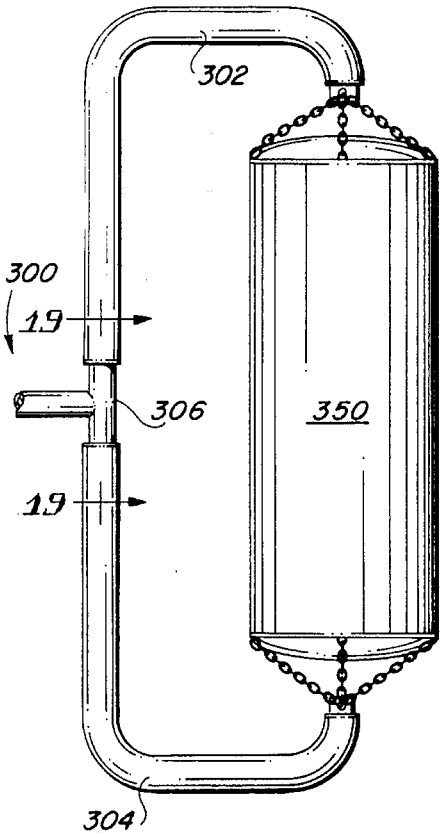
FIG. 18 is a perspective view of an alternate bag suspension support.

In FIG. 18, a generally C-shaped suspension frame 300 is shown similar to the frame 14 shown in FIG. 1. As seen in FIG. 19, frame 300 has an upper section 302 and a lower section 304 interconnected at cylindrical coupling 306. The upper and lower suspension frame members are secured to an intermediate coupling 306 by bolts 310 and 312. A spring 315 is housed within coupling 306 and, as best seen in FIG. 19, has opposite ends 320 and 322 which are each disklike members having a diametrally extending bars 325 and 326, respectively. The spring 315 is captured between the bolts 310 and 312. A first suspension cable 328 extends from the upper ring 320 and is secured to the bar 325 by a cable loop formed by a crimped collar, as shown. As seen in FIG. 21, the cable 328 extends through the hollow lower suspension frame member 304. The end of the cable is secured to a compression spring 330 which, in turn, is secured to one end of a turn buckle 355. The turn buckle 355 provides vertical adjustability and the opposite end of the turn buckle is secured to the bag 350 at an eye 340.

The upwardly extending cable 332 is secured to the disk 322 at the lower end of the spring at bar 326 and the cable extends through the interior of the upper member 302 being secured to the upper end of the bag by a spring and turn buckle assembly similar to that shown in FIG. 21. In this manner it will be seen that the bag is oppositely suspended by a resilient system which can be adjusted to provide variability of tension. Blows imparted to the bag will be absorbed at the springs 330 as well as at the central spring 315 within the tubular suspension frame structure. The desired tension can be selected and adjusted by the user.

Figure 22:
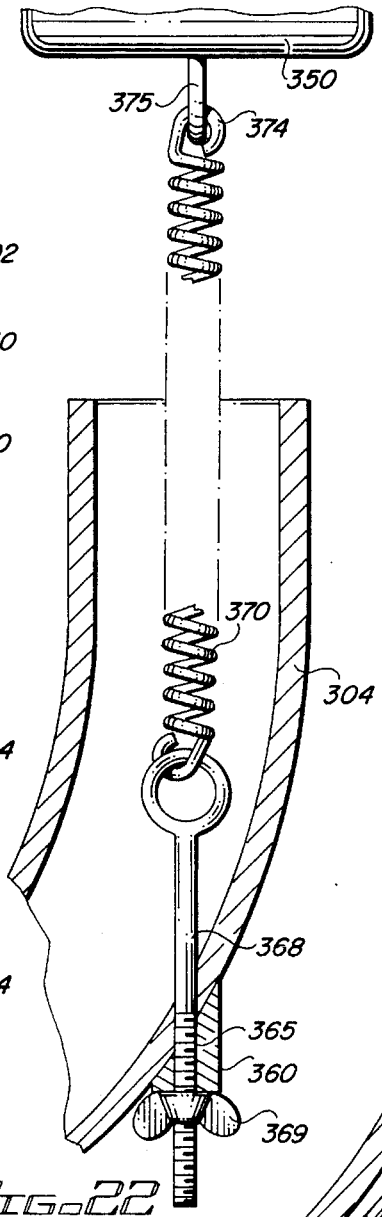
FIG. 22 is a sectional view of the end of the frame showing another arrangement for attaching the bag.

FIG. 22 shows another bag suspension system. In this Figure, the upper end of the lower suspension frame member is a member such as frame arm member 304 as previously described with respect to FIG. 18. It will be understood that the upper end of the bag is attached to the lower end of the upper arm which is similar in construction. The arm 304 is hollow and defines a boss 360 near its end which has an aperture 365 through which an eye bolt 368 extends. The lower end of the eye bolt carries a wing nut 369. A spring 370 is secured to the eye of the eye bolt and has a hook 374 at its opposite end which attaches to a lug or eye 375 on the bag. In this way, the opposite ends of the bag are resiliently restrained. The resiliency or spring tension can be adjusted at either or both ends by adjusting wing nut 369 or by changing the spring to one having different spring rate.

As indicated above, the punching bag apparatus of the present invention can be used in connection with bags of various sizes and shapes. FIGS. 23 through 26 show a constructional variation of the bag from the more conventional cylindrical bag such as shown in FIG. 1. In these figures, the bag is represented by the numeral 400 and has a generally circular periphery 402 which presents a substantially planar striking surface 404. The bag is supported on a horizontal support arm 410 which may be secured to the support apparatus such as that shown in FIGS. 1 or 8. The bag has a generally rigid back panel 412 with one or more layers 416 and 418 of resilient or elastomeric material such as foam rubber. The outer surface of the bag is covered with a suitable material such as a canvas or leather covering 420.

The bag is mounted on horizontal support shaft 410 for universal movement. To this end, a bearing block 425 is secured to the back panel 412 by a plurality of fasteners 430. The inner end of the shaft 410 carries a generally spherical ball 432 which is seated within the bearing block to facilitate universal movement of the bag.

Figure 24:
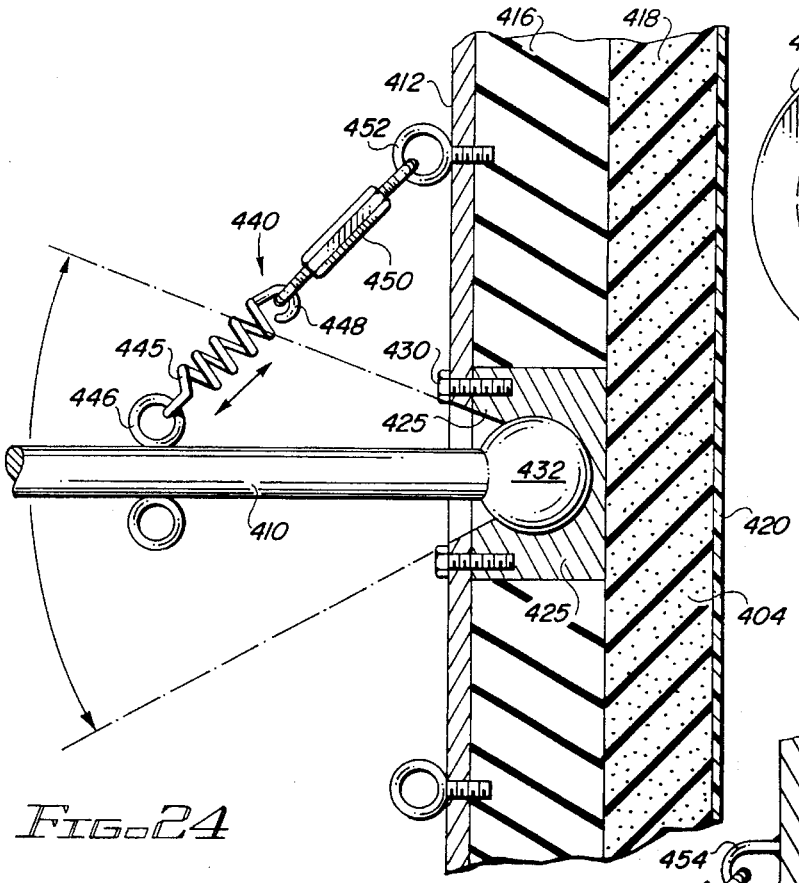
FIG. 24 is a partial side view of the bag shown in FIG. 23.
Figure 23:
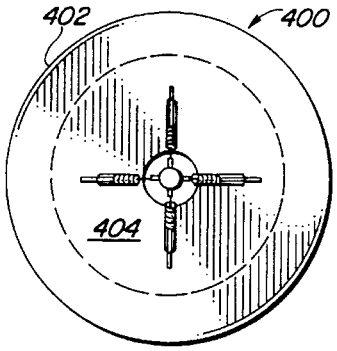
FIG. 23 is a plan view of an alternate punching bag construction.

Resistance to punches is provided by spring tension between the rear of the bag and the mounting shaft 410 at selected locations. As seen in FIG. 24, spring tension assemblies 440 are provided at locations spaced 90° apart. Each of the assemblies consist of a spring 445 secured to an eye 446 welded to the shaft 410. The opposite end of the spring carries a hook 448 which is secured to a turn buckle 450. The opposite end of the turn buckle is secured to the eye 452 of an eye bolt secured to rigid panel 412 at a position radially spaced from the shaft 410. These assemblies will allow adjustability of the position of the bag relative to the shaft 410. Blows imparted to the planar surface 404 will be resisted by the spring assemblies and the spring assemblies will also return the bag to its initial position prior to being struck.

Figure 25:
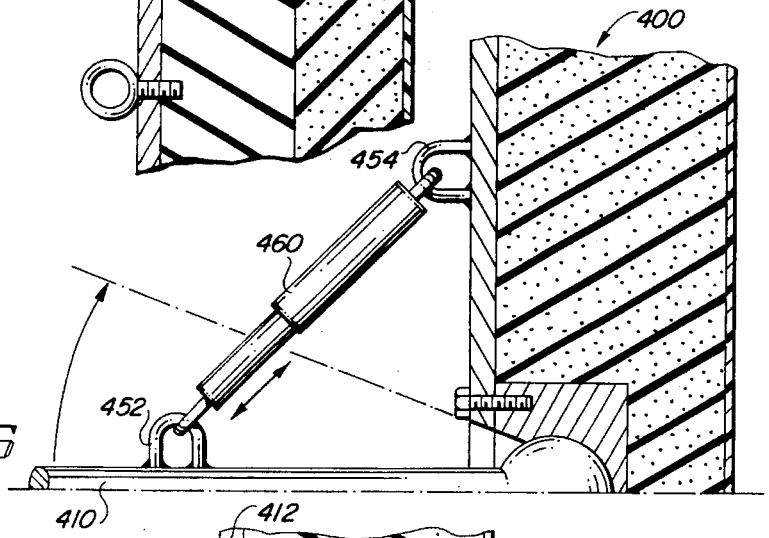
FIGS. 25 and 26 are views similar to FIG. 24 showing an alternate spring or shock absorbing arrangement for securing the punching bag to the horizontal support arm.

FIG. 25 shows an alternate mounting arrangement for the bag in which resistance is provided by a plurality of circumferentially arranged shock absorbers 460 extending between the bag 400 at mounting lugs 452 and a mounting lug 454 on shaft 410. A plurality of shock absorbers 460 would be provided at equally spaced apart locations about the shaft 410. The shock absorbers may be a conventional pneumatic or hydraulic shock absorber preferably providing adjustable resistance.

Figure 26:
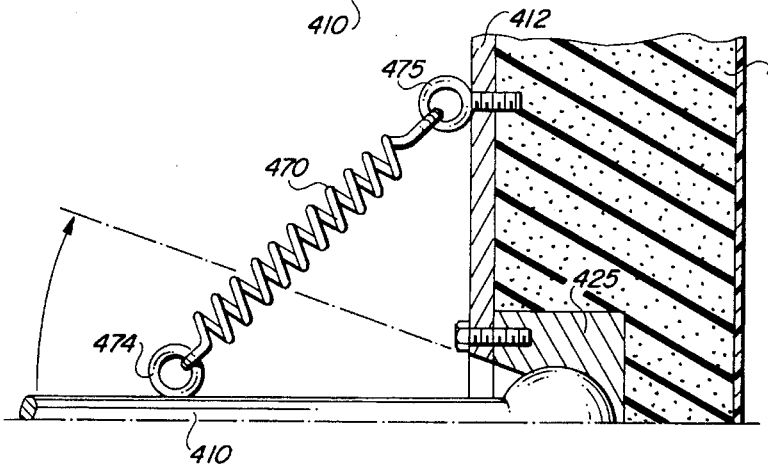

In FIG. 26, another arrangement is shown in which spaced-apart springs 470 extend between a mounting lug 474 on the shaft 410 and a mounting lug 475 located in panel 412, at the rear of the bag. The springs provide a resistance to blows and springs can be removed and replaced with springs having the desired spring rate.

Figure 27:
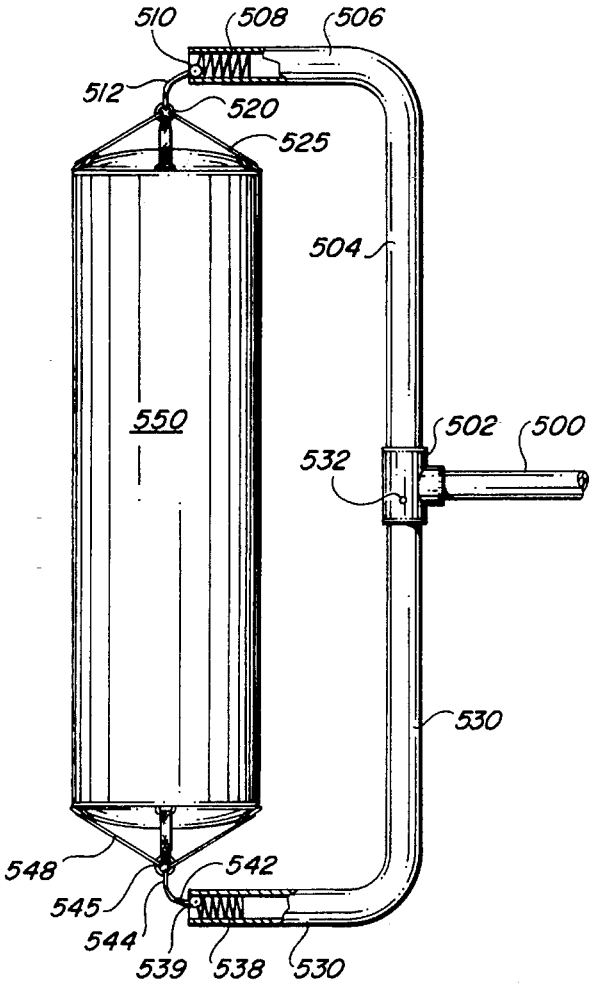
FIG. 27 shows yet another bag suspension arrangement.

FIG. 27 shows still another bag suspension system which has a shaft 500 attachable to the support, as for example, those shown in FIGS. 1 and 8. The shaft 500 is secured to a tee coupling 502 which has an upper arm that terminates at a horizontal section 506. A spring 508 is received within the end of the arm and is retained by a roller 510 that extends transversely within the distal end of arm 506. Cable 512 is secured to the inner end of the spring 508, extending over roller 510 to ring 520. Ring 520 supports a plurality of straps or chain sections 525 which are attached at their opposite ends to the upper end of bag 550.

A lower arm 530 is received within the lower outlet of tee 502 and is removably retained by a pin 532. Arm 530 is similar to arm 504 terminating at horizontal section 536. Spring 538 receives one end of cable 542 which extends around roller 539. The opposite end of cable 542 is secured by a snap ring 544 to ring 545 which, in turn, is attached to the lower end of the bag by straps or chains 548. The advantage of this suspension is that arm 530 may be detached at pin 532 and at snap ring 544 leaving the bag 550 freely suspended from upper arm 504.

It will be seen from the foregoing that the punching bag assembly of the present invention accomplishes the various objects and achieves the advantages set forth above. The boxer may use the apparatus with a heavy bag such as bag 12 suspended in a vertical position to practice body punches. The martial arts participant may adjust the bag to the desired height and angular orientation in order to practice various specialized kicks and punches. Bags of various shapes, sizes and configuration can be used with the apparatus. The device may also be adjusted to provide the desired spring resistance consistent with the practice regimen. The device is easily portable and may be placed in a compact position for storage when not in use.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A sport training device comprising:

(a) base member;

(b) a support attached to and upwardly extending from the base member;

(c) a height adjustment member engaging the support and being vertically adjustable with respect to the support;

(d) an arm extending from said height adjustment member and terminating at a connector, one of said connector and said arm being rotatably adjustable about a generally horizontal axis;

(c) a substantially C-shaped suspension frame member having opposite ends and defining a bag suspension area therebetween, said frame member being attached to said connector to thereby allow said frame member to be vertically and angularly adjusted with respect to said connector; and (f) a punching bag having attachment means for suspending said punching bag from said suspension frame, at one end and anchoring said bag at the other end, in said bag-suspension area whereby the height and angular position of said punching bag may be selectively adjusted, along with said frame.

2. The sport training device of claim 1 wherein said bag is generally circular.

3. The sport training device of claim 1 wherein said bag is a generally elongate cylindrical bag having a resilient exterior defining a hollow interior.

4. The sport training device of claim 1 wherein said base comprises a plurality of outwardly extending legs.

5. The sport training device of claim 4 further including caster means associated with said legs.

6. The sport training device of claim 5 wherein said casters are movable between a first position supporting said device for mobility and a second out-of-the-way position.

7. The sport training device of claim 4 including resilient pad means positioned on the underside of said legs.

8. The sport training device of claim 1 wherein said height adjustment member is vertically adjustable at a detent means and wherein said height adjustment member comprises a vertically extending mast member.

9. The sport training device of claim 8 wherein said mast member is received within a bore in said support and is rotatable with respect to said support and further including locking means for securing said mast member in a selected rotative position.

* * * * *